US009963657B2

(12) United States Patent
Desantis et al.

(10) Patent No.: US 9,963,657 B2
(45) Date of Patent: May 8, 2018

(54) LUBRICANT COMPOSITION

(71) Applicant: BASF SE, Ludwigshafen (DE)

(72) Inventors: Kevin J. Desantis, Upper Nyack, NY (US); Michael D. Hoey, Maplewood, NJ (US); Stephen R Jones, Pomona, NY (US)

(73) Assignee: BASF SE, Ludwigshafen (DE)

( * ) Notice: Subject to any disclaimer, the term of this patent is extended or adjusted under 35 U.S.C. 154(b) by 0 days. days.

(21) Appl. No.: 14/392,397

(22) PCT Filed: Nov. 4, 2014

(86) PCT No.: PCT/US2014/063856
§ 371 (c)(1),
(2) Date: May 4, 2016

(87) PCT Pub. No.: WO2015/066685
PCT Pub. Date: May 7, 2015

(65) Prior Publication Data

US 2016/0289587 A1 Oct. 6, 2016

Related U.S. Application Data

(60) Provisional application No. 61/899,629, filed on Nov. 4, 2013, provisional application No. 61/899,686, filed on Nov. 4, 2013.

(51) Int. Cl.
*C10M 141/00* (2006.01)
*C10M 141/08* (2006.01)
(Continued)

(52) U.S. Cl.
CPC ..... *C10M 141/08* (2013.01); *C10L 1/22* (2013.01); *C10L 1/24* (2013.01); *C10L 10/08* (2013.01); *C10M 133/04* (2013.01); *C10M 133/06* (2013.01); *C10M 133/40* (2013.01); *C10M 135/10* (2013.01); *C10M 139/04* (2013.01); *C10M 141/06* (2013.01); *C10M 141/10* (2013.01); *C10M 163/00* (2013.01); *C10L 1/2222* (2013.01); *C10L 1/2431* (2013.01); *C10L 2200/0263* (2013.01); *C10L 2270/02* (2013.01); *C10L 2270/026* (2013.01); *C10L 2290/24* (2013.01); *C10M 2203/1006* (2013.01); *C10M 2203/1025* (2013.01); *C10M 2205/0285* (2013.01); *C10M 2207/023* (2013.01); *C10M 2207/028* (2013.01); *C10M 2207/12* (2013.01); *C10M 2207/14* (2013.01); *C10M 2207/144* (2013.01); *C10M 2207/26* (2013.01); *C10M 2207/262* (2013.01); *C10M 2209/084* (2013.01); *C10M 2215/02* (2013.01); *C10M 2215/04* (2013.01); *C10M 2215/044* (2013.01); *C10M 2215/064* (2013.01); *C10M 2215/221* (2013.01); *C10M 2215/28* (2013.01); *C10M 2219/044* (2013.01); *C10M 2219/046* (2013.01); *C10M 2223/045* (2013.01); *C10M 2223/065* (2013.01); *C10M 2227/04* (2013.01); *C10M 2229/02* (2013.01); *C10N 2220/021* (2013.01); *C10N 2230/04* (2013.01); *C10N 2230/18* (2013.01); *C10N 2230/45* (2013.01); *C10N 2230/50* (2013.01); *C10N 2230/52* (2013.01);
(Continued)

(58) Field of Classification Search
CPC . C10L 10/08; C10L 2270/02; C10N 2230/04; C10N 2230/18; C10N 2230/52; C10N 2240/10; C10M 133/06; C10M 135/10; C10M 133/40; C10M 133/04; C10M 139/04; C10M 2215/04; C10M 2215/02; C10M 2215/221; C10M 2219/046; C10M 2227/04
See application file for complete search history.

(56) References Cited

U.S. PATENT DOCUMENTS 4,906,389 A 3/1990 Brownawell et al.
8,334,245 B2 12/2012 Lancon et al.
(Continued)

FOREIGN PATENT DOCUMENTS

CA 2020552 A1 1/1991
EP 2 319 904 A1 5/2011
(Continued)

OTHER PUBLICATIONS

International Search Report for Application No. PCT/US2014/063856 dated Feb. 10, 2015, 4 pages.
(Continued)

*Primary Examiner* — Cephia D Toomer
(74) *Attorney, Agent, or Firm* — Lowenstein Sandler LLP

(57) ABSTRACT

A lubricant composition for a compression-ignition internal combustion engine comprises: (i) an amine as an ashless fuel additive having a total base number ("TBN") of from about 275 to about 600 mg KOH/g when tested according to ASTM D2896; and (ii) a detergent selected from metal sulfonates, phenates, salicylates, carboxylates, thiophosphonates, and combinations thereof. The lubricant composition has a TBN of from about 20 to about 130 mg KOH/g when tested according to ASTM D2896. The amine contributes greater than about 30% of the TBN of the lubricant composition. Further, a method of lubricating an internal combustion engine with the lubricant composition comprises the steps of injecting a fuel and the lubricant composition into a cylinder to form a mixture, and combusting the mixture via compression-ignition.

15 Claims, No Drawings

(51) Int. Cl.

| | |
|---|---|
| ***C10M 133/04*** | (2006.01) |
| ***C10M 141/06*** | (2006.01) |
| ***C10M 141/10*** | (2006.01) |
| ***C10L 10/08*** | (2006.01) |
| ***C10M 133/06*** | (2006.01) |
| ***C10M 133/40*** | (2006.01) |
| ***C10M 135/10*** | (2006.01) |
| ***C10M 139/04*** | (2006.01) |
| ***C10L 1/22*** | (2006.01) |
| ***C10L 1/24*** | (2006.01) |
| ***C10M 163/00*** | (2006.01) |
| *C10L 1/222* | (2006.01) |

(52) U.S. Cl.
CPC ..... *C10N 2230/54* (2013.01); *C10N 2240/10* (2013.01); *C10N 2240/102* (2013.01)

(56) References Cited

U.S. PATENT DOCUMENTS

| | | | | |
|---|---|---|---|---|
| 2006/0116300 | A1 | 6/2006 | Arrowsmith et al. | |
| 2006/0172899 | A1 | 8/2006 | Tipton et al. | |
| 2007/0203031 | A1* | 8/2007 | Bardasz | C10M 133/56 508/192 |
| 2008/0188386 | A1 | 8/2008 | Burrington et al. | |
| 2010/0101518 | A1 | 4/2010 | Bardasz et al. | |
| 2012/0202728 | A1* | 8/2012 | Garcia Ojeda | C10M 163/00 508/545 |
| 2013/0252865 | A1* | 9/2013 | Hartley | C10M 133/12 508/435 |
| 2014/0213493 | A1 | 7/2014 | Chase et al. | |

FOREIGN PATENT DOCUMENTS

| | | | |
|---|---|---|---|
| EP | 2 366 761 | A1 | 9/2011 |
| EP | 2 574 656 | A1 | 4/2013 |
| JP | H 02-252913 | A | 10/1990 |
| JP | 2005-146010 | A | 6/2005 |
| JP | 2011-524926 | A | 9/2011 |
| WO | WO 2008/015116 | A2 | 2/2008 |
| WO | WO 2011042552 | A1 | 4/2011 |
| WO | WO 20121222202 | A1 | 9/2012 |
| WO | WO 2012/166781 | A1 | 12/2012 |

OTHER PUBLICATIONS

International Search Report for Application No. PCT/US2014/063863 dated Feb. 10, 2015, 4 pages.
PCT Written Opinion for PCT/US2014/063856 dated Feb. 10, 2015, 6 pages.
PCT Written Opinion for PCT/US2014/063863 dated Feb. 10, 2015, 6 pages.
English language abstract for JPH 02-252913 extracted from espacenet.com database on Dec. 1, 2016, 2 pages.
English language abstract and machine-assisted English translation for JP 2005-146010 extracted from espacenet.com database on Dec. 1, 2016, 24 pages.
English language abstract for JP 2011-524926 extracted from espacenet.com database on Dec. 1, 2016, 2 pages.

* cited by examiner

LUBRICANT COMPOSITION

This application is the National Stage of International Patent Application No. PCT/US2014/063856, filed on Nov. 4, 2014, which claims priority to U.S. Provisional Patent Application Ser. Nos. 61/899,629 and 61/899,686, filed on Nov. 4, 2013, the contents of each of which are expressly incorporated herein by reference in one or more non-limiting embodiments.

FIELD OF THE DISCLOSURE

The subject disclosure generally relates to an amine as an ashless fuel additive and also to a lubricant composition comprising the amine.

DESCRIPTION OF THE RELATED ART

Many internal combustion engines, such as those found in marine vessels, trains, motorcycles, scooters, ATV's, and lawn equipment, combust a mixture of a fuel and a lubricant composition. Specifically, the mixture is introduced into a cylinder of the engine and combusted to move a piston and power the engine. The lubricant composition is added to the fuel to lubricate various components of the engine (e.g. the cylinder and the piston) and to optimize combustion, fuel economy, emissions, and engine life. The lubricant composition includes base oil and additives such as antiwear additives, dispersants, and detergents.

However, during combustion, impurities in the fuel and additives, such as overbased detergents and other additives comprising metal, do not fully combust and "burn out". As a result, ash is formed. Some of the ash formed remains in the cylinder, and can cause the build up of "deposits" and even "plate out" onto the engine components (e.g. the cylinder and the piston) eventually damaging the engine, reducing fuel economy, and ultimately reducing engine life.

For example, ocean going marine vessels are fueled by the combustion of a mixture of crude fuel, which often comprises sulfur in high concentrations, and a lubricant composition when out at sea. The lubricant compositions used in this mixture include an overbased detergent such as calcium carbonate. The overbased detergent is present to neutralize acid which is formed by the combustion of the sulfur. However, when in emission controlled (EC) areas (e.g. coastal areas with higher environmental standards), these ocean going marine vessels are alternatively fueled by the combustion of a mixture of more refined fuel, which typically comprises less sulfur, and the lubricant composition in an effort to reduce pollutants produced during combustion. When the more refined, low sulfur fuel is combusted, less acid is formed. In turn, there is an excess of overbased detergent which forms ash and plates out onto cylinder walls and other engine components thereby damaging the engine, reducing fuel economy, and ultimately reducing engine life. To this end, there is a need for lubricant compositions that can accommodate variations in fuel sulfur levels (e.g. between crude fuel and refined fuel). Such lubricant compositions should reduce the formation of ash, and thereby minimize engine damage, improve fuel economy, and control emissions despite variations in fuel sulfur levels.

SUMMARY OF THE DISCLOSURE

A lubricant composition for a compression-ignition internal combustion engine is disclosed. The lubricant composition comprises: (i) an amine as an ashless fuel additive having a total base number ("TBN") of from about 275 to about 600 mg KOH/g when tested according to ASTM D2896; and (ii) a detergent selected from metal sulfonates, phenates, salicylates, carboxylates, thiophosphonates, and combinations thereof. The lubricant composition has a TBN of from about 20 to about 130 mg KOH/g when tested according to ASTM D2896. The amine contributes greater than about 30% of the TBN of the lubricant composition.

A method of lubricating an internal combustion engine with the lubricant composition is also disclosed. The method of lubricating an internal combustion engine comprises the steps of injecting a fuel and the lubricant composition into a cylinder to form a mixture, and combusting the mixture via compression-ignition.

DETAILED DESCRIPTION OF THE DISCLOSURE

A lubricant composition for a compression-ignition internal combustion engine ("the lubricant composition") is disclosed herein. The lubricant composition comprises an amine as an ashless fuel additive ("the amine"), and a detergent. The lubricant composition can comprise one or more of the amine, i.e., a single type of the amine or more than one type of the amine. The amine is basic, soluble in base oils and fuels, and chemically stable, yet does not produce ash when combusted (i.e., is ashless according to ASTM D 874 and as understood in the art). Typically, the terminology "ashless" refers to the absence of significant amounts of metals such as sodium, potassium, calcium, and the like.

The amine neutralizes acid but does not form ash which, as described above, can damage engine components, reduce fuel economy, and ultimately reduce engine life. The amine effectively neutralizes acids because of its basicity. A minimal amount of the amine can be added to neutralize or "treat" fuel. That is, the amine can be used at a low "treat rate". The basicity of the amine is quantified by its total base number ("TBN"). TBN can be calculated theoretically and can also be determined according to ASTM D2896 and/or ASTM D4739. The amine may have a TBN of greater than about 150, alternatively greater than about 195, alternatively greater than about 200, alternatively greater than about 250, alternatively greater than about 270, alternatively greater than about 290, alternatively greater than about 310, alternatively from about 200 to about 800, alternatively from about 200 to about 600, alternatively from about 275 to about 600, alternatively from about 250 to about 600, alternatively from about 250 to about 550, alternatively from about 500 to about 600, alternatively from about 500 to about 800, mg KOH/g when tested according to ASTM D4739. Alternatively, the amine may have a TBN of at least about 200, at least about 250, at least about 300, at least about 350, at least about 450, or at least about 500, mg KOH/g, when tested according to ASTM D4739.

The lubricant composition also has a TBN. The various components of the lubricant composition, e.g. the amine, the detergent, the dispersant, etc., contribute to the TBN of the lubricant composition. In various embodiments, the lubricant composition has a TBN of from about 20 to about 130, alternatively from about 20 to about 90, alternatively from about 30 to about 90, alternatively from about 35 to about 85, alternatively from about 40 to about 110, alternatively from about 50 to about 90, alternatively from about 60 to about 80, mg KOH/g when tested according to ASTM D4739. In some embodiments, the amine contributes greater than about 30%, alternatively greater than about 40%, alternatively greater than about 50%, to the TBN of the lubricant composition. For example, when the amine contributes greater than 40% to the TBN of a lubricant composition having a TBN of 70 mg KOH/g, the amine contributes greater that 28 mg KOH/g to the TBN of the lubricant composition. The greater the contribution of the amine to the TBN of the lubricant composition, the less ash producing detergent required to maintain the desired TBN of the lubricant. That is, the greater the impact of the amine on the TBN of the lubricant composition, the less need the need for detergents, which produce ash, in the lubricant composition. To this end, the amine contributes to the TBN of the lubricant composition, which allows for use of less detergent in the lubricant composition. In a preferred embodiment, a TBN contribution of the amine to the TBN of the lubricant composition is greater than a TBN contribution of the detergent to the TBN of the lubricant composition.

To this end, a method of treating a lubricant composition with the amine is also disclosed herein. The method includes the step of adding the amine to the lubricant composition. In this method, the step of adding the amine is typically defined as combining the lubricant composition and the amine at a treat rate of less than 45, alternatively less than 40, alternatively less than 35, alternatively less than 30, alternatively less than 25, alternatively less than 20, alternatively less than 15, alternatively less than 10, alternatively less than 5, alternatively from 1 to 45, alternatively from 5 to 40, alternatively from 8 to 40, alternatively from 15 to 40, wt. % amine based on the total weight of the lubricant composition. Of course, the treat rate is directly related to the TBN number of the amine. Typically, the higher the TBN of the amine, the lower the treat rate. Of course, the treat rate is lower for lubricant compositions that include a detergent, e.g. for partial replacement of the detergent with the amine.

The amine can include one or more amine groups. The amine can include a tertiary amine group, a secondary amine group, a primary amine group, or combinations thereof. In various embodiments, the amine has weight average molecular weight ($M_w$) of from about 100 to about 700, alternatively from about 100 to about 550, alternatively from about 100 to about 400, alternatively from about 200 to about 300, g/mol.

In various embodiments, the amine has the general formula:

$$C_WH_XN_YO_Z$$

wherein W is from 5 to 30; X is from 20 to 60; Y is from 1 to 5; and Z is from 0 to 5.

In various embodiments, the amine has the following general structure:

(GSI)

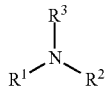

wherein $R^1$, $R^2$, and $R^3$ are independently a hydrogen atom or a $C_1$ through $C_{15}$ hydrocarbon group. In one embodiment, at least one of $R^1$, $R^2$, and $R^3$ is a branched or a cyclic hydrocarbon group. In another embodiment, at least two of $R^1$, $R^2$, and $R^3$ of general structure (I) are a branched or a cyclic hydrocarbon group. In such embodiments, the amine is a secondary or tertiary amine.

In various embodiments, the amine is a tertiary amine. For example, in one embodiment, the amine is tributylamine ($C_{12}H_{27}N$, Mw 185 g/mol), which has the following structure:

(I)

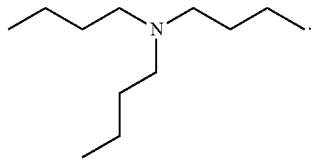

In this embodiment, the amine has a TBN of about 286 mg KOH/g when tested according to ASTM D2896.

In other embodiments, the amine is a secondary amine. For example, in one embodiment, the amine is di(2-ethylhexyl)amine ($C_{16}H_{35}N$, $M_w$ 242 g/mol), which has the following structure:

(II)

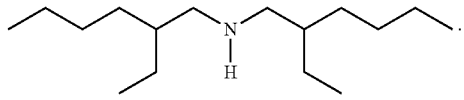

In this embodiment, the amine has a TBN of about 292 mg KOH/g when tested according to ASTM D2896.

As another example, the amine is n-butyl-2,2,6,6-tetramethylpiperidin-4-amine ($C_{13}H_{28}N_2$, $M_w$ 212 g/mol), which has the following structure:

(III)

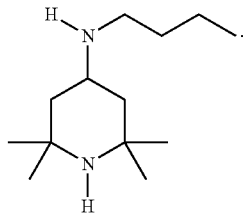

In this embodiment, the amine has a TBN of about 530 mg KOH/g when tested according to ASTM D2896. As such, the amine of structure (III) can be added to the lubricant composition in smaller quantities than amines having a lower TBN and to achieve the desired TBN value of the lubricant composition. That is, because of its structure and basicity, the amine structure (III) is very efficient in, and has excellent solubility in, the lubricant composition.

In other embodiments, the amine is a primary amine. For example, in one embodiment, the amine is 7,8,9,-trimethyldeacan-1-amine ($C_{13}H_{29}N$, $M_w$ 242 g/mol), which has the following structure:

(IV)

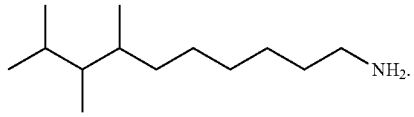

In this embodiment, the amine has a TBN of about 278 mg KOH/g when tested according to ASTM D2896.

In one embodiment, the amine is selected from:

(I)

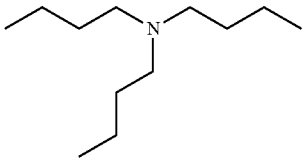

(II)

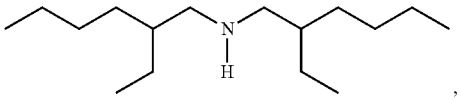

(III)

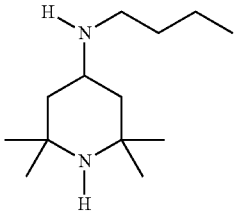

(IV)

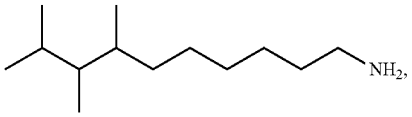

and combinations thereof.

In various embodiments, the amine is present in the lubricant composition in an amount of from about 1 to about 45, alternatively from about 2 to about 40, alternatively from about 2 to about 15, alternatively from about 5 to about 15, alternatively from about 10 to about 15, wt. % based on the total weight of the lubricant composition. Alternatively, the amine may be included in the lubricant composition in an amount of greater than about 2, alternatively greater than about 3, alternatively greater than about 4, alternatively greater than about 5, alternatively greater than about 6, alternatively greater than about 7, alternatively greater than about 8, alternatively greater than about 9, alternatively greater than about 10, wt. % based on the total weight of the lubricant composition. The amount of amine may vary outside of the ranges above, but is typically both whole and fractional values within these ranges. Further, it is to be appreciated that more than one amine may be included in the lubricant composition, in which case the total amount of all the amine included is within the above ranges.

The lubricant composition also includes a detergent. The detergent is typically selected from overbased or neutral metal sulfonates, phenates and salicylates, and combinations thereof. For example, in various embodiments, the detergent is selected from metal sulfonates, phenates, salicylates, carboxylates, thiophosphonates, and combinations thereof. In one embodiment, the detergent comprises an overbased metal sulfonate, such as calcium sulfonate. In another embodiment, the detergent comprises an overbased metal salicylate, such as calcium metal salicylate. In yet another embodiment, the detergent comprises an alkyl phenate detergent.

The detergent typically includes metals such as sodium, potassium, calcium, and the like which can react to form ash. It is believed that inclusion of the amine in the additive composition reduces the amount of detergent required in the lubricant composition. Since the amine is ashless, and the amount excess of detergent, e.g. overbased detergent, which forms ash and plates out onto cylinder walls and other engine components, is reduced, the damaging effects of the overbased detergent are also reduced.

If included, the detergent may be included in the lubricant composition in an amount of from about 0.1 to about 35, alternatively from about 0.1 to about 30, alternatively from about 0.1 to about 25, alternatively from about 0.1 to about 20, alternatively from about 0.1 to about 15, alternatively from about 0.1 to about 10, alternatively from about 0.1 to about 5, wt. % based on the total weight of the lubricant composition. Alternatively, the detergent may be included in the lubricant composition in amounts of less than about 35, less than about 30, less than about 25, less than about 20, less than about 15, less than about 10, less than about 5, or less than about 1, wt. %, each based on the total weight of the lubricant composition. The amount of detergent may vary outside of the ranges above, but is typically both whole and fractional values within these ranges. Further, it is to be appreciated that more than one detergent may be included in the lubricant composition, in which case the total amount of all the detergent included is within the above ranges.

The lubricant composition may also include a dispersant. In various embodiments, the lubricant composition does not include a dispersant. In embodiments where the lubricant composition does not include, or is substantially free of (e.g., includes less than about 5, alternatively less than about 2, alternatively less than about 1, alternatively less than about 0.1, alternatively about 0, wt. % based on the total weight of the lubricant composition) the dispersant, it is believed that the amine's compatibility and solubility in the lubricant composition allows for inclusion of a reduced amount of or no dispersant in the lubricant composition.

In other embodiments, the lubricant composition includes a dispersant. The dispersant comprises a polyalkenyl succinic anhydride polyamine and/or a polyalkenyl succinimide polyamine. While not intending to be bound by theory, it is contemplated that the dispersant (e.g. the polyalkenyl succinic anhydride polyamine and/or the polyalkenyl succinimide polyamine), when present, contributes to the solubility of the amine in the base oil. Additional dispersants such as polybutenylphosphonic acid derivatives and basic magnesium, calcium and barium sulfonates and phenolates, succinate esters and alkylphenol amines (Mannich bases), polyalkene amines, and combinations thereof can also be included in the lubricant composition.

In one embodiment, the dispersant comprises a polyalkenyl succinic anhydride polyamine, such as polybutenyl succinic anhydride polyamine ("PIBSA-PAM"). In this embodiment, the PIBSA-PAM has weight average molecular weight ($M_w$) of from about 200 to about 3000, alternatively from about 200 to about 1500, alternatively from about 400 to about 1200, alternatively from about 600 to about 1200, alternatively from about 850 to about 950, alternatively about 900, g/mol.

In another embodiment, the dispersant comprises a polyalkenyl succinimide polyamine, such as polyisobutylenesuccinimide ("PIBSI"). In this embodiment, the PIBSI has weight average molecular weight ($M_w$) of from about 200 to about 3000, alternatively from about 200 to about 1500, alternatively from about 600 to about 1200, alternatively from about 850 to about 950, alternatively about 900, g/mol.

If included, the dispersant may be included in the lubricant composition in an amount of from about 0.1 to about 15, alternatively from about 0.1 to about 10, alternatively from about 0.1 to about 8, alternatively from about 0.1 to about 6, alternatively from about 0.1 to about 4, alternatively from about 0.1 to about 3, alternatively from about 1 to about 3, wt. % based on the total weight of the lubricant composition. Alternatively, the dispersant may be included in the lubricant composition in amounts of less than about 15, less than about 12, less than about 10, less than about 5, or less than about 4, wt. %, each based on the total weight of the lubricant composition. The amount of dispersant may vary outside of the ranges above, but is typically both whole and fractional values within these ranges. Further, it is to be appreciated that more than one dispersant may be included in the lubricant composition, in which case the total amount of all the dispersant included is within the above ranges.

The lubricant composition may also include a base oil. The base oil is classified according to the American Petroleum Institute (API) Base Oil Interchangeability Guidelines. That is, the base oil may be further described as one or more of five types of base oils: Group I (sulfur content >0.03 wt. %, <90 wt. % saturates, viscosity index 80-120); Group II (sulfur content less than or equal to 0.03 wt. %, and greater than or equal to 90 wt. %, saturates viscosity index 80-120); Group III (sulfur content less than or equal to 0.03 wt. %, and greater than or equal to 90 wt. % saturates, viscosity index greater than or equal to 120); Group IV (all polyalphaolefins (PAO's); and Group V (all others not included in Groups I, II, III, or IV).

In one embodiment, the base oil is selected from American Petroleum Institute (API) Group I oil, API Group II oil, API Group III oil, API Group IV oil, API Group V, and combinations thereof. In another embodiment, the base oil comprises an API Group I oil. In yet another embodiment, the base oil comprises an API Group II oil.

In still other embodiments, the base oil may be further defined as synthetic oil that includes one or more alkylene oxide polymers and interpolymers, and derivatives thereof. The terminal hydroxyl groups of the alkylene oxide polymers may be modified by esterification, etherification, or similar reactions. These synthetic oils may be prepared through polymerization of ethylene oxide or propylene oxide to form polyoxyalkylene polymers which can be further reacted to form the synthetic oil. For example, alkyl and aryl ethers of these polyoxyalkylene polymers may be used. For example, methylpolyisopropylene glycol ether having an average molecular weight of 1000; diphenyl ether of polyethylene glycol having a molecular weight of 500-1000; or diethyl ether of polypropylene glycol having a molecular weight of 1000-1500 and/or mono- and polycarboxylic esters thereof, such as acetic acid esters, mixed $C_3$-$C_8$ fatty acid esters, and the $C_{13}$ oxo acid diester of tetraethylene glycol may also be utilized as the base oil.

The base oil may be included in the lubricant composition in an amount of from about 40 to about 99.9, alternatively from about 50 to about 99.9, alternatively from about 50 to about 95, alternatively from about 50 to about 80, wt. % based on the total weight of the lubricant composition. Alternatively, the base oil may be included in the lubricant composition in amounts of greater than about 50, alternatively greater than about 60, alternatively greater than about 70, alternatively greater than about 75, alternatively greater than about 80, alternatively greater than about 85, alternatively greater than about 90, alternatively greater than about 95, wt. % based on the total weight of the lubricant composition. The amount of base oil may vary outside of the ranges above, but is typically both whole and fractional values within these ranges. Further, it is to be appreciated that more than one base oil may be included in the lubricant composition, in which case the total amount of all the base oil included is within the above ranges.

The lubricant composition may also include an antiwear additive. Any antiwear additive known in the art may be included. Suitable, non-limiting examples of the antiwear additive include zinc dialkyl-dithio phosphate ("ZDDP"), zinc dialkyl-dithio phosphates, sulfur- and/or phosphorus- and/or halogen-containing compounds, e.g. sulfurised olefins and vegetable oils, zinc dialkyldithiophosphates, alkylated triphenyl phosphates, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, bis(2-ethylhexyl)aminomethyltolyltriazole, derivatives of 2,5-dimercapto-1,3,4-thiadiazole, ethyl 3-[(diisopropoxyphosphinothioyl)thio]propionate, triphenyl thiophosphate (triphenylphosphorothioate), tris(alkylphenyl) phosphorothioate and mixtures thereof (for example tris(isononylphenyl) phosphorothioate), diphenyl monononylphenyl phosphorothioate, isobutylphenyl diphenyl phosphorothioate, the dodecylamine salt of 3-hydroxy-1,3-thiaphosphetane 3-oxide, trithiophosphoric acid 5,5,5-tris[isooctyl 2-acetate], derivatives of 2-mercaptobenzothiazole such as 1-[N,N-bis (2-ethylhexyl)aminomethyl]-2-mercapto-1H-1,3-benzothiazole, ethoxycarbonyl-5-octyldithio carbamate, ashless antiwear additives including phosphorous, and/or combinations thereof. In one embodiment, the antiwear additive comprises ZDDP.

If included, the antiwear additive may be included in the lubricant composition in an amount of from about 0.1 to about 10, alternatively from about 0.1 to about 5, alternatively from about 0.1 to about 4, alternatively from about 0.1 to about 3, alternatively from about 0.1 to about 2, alternatively from about 0.1 to about 1, alternatively from about 0.1 to about 0.5, wt. % based on the total weight of the lubricant composition. Alternatively, the antiwear additive may be included in the lubricant composition in amounts of less than about 10, less than about 9, less than about 8, less than about 7, less than about 6, less than about 5, less than about 4, less than about 3, less than about 2, or less than about 1, wt. %, each based on the total weight of the lubricant composition. The amount of antiwear additive may vary outside of the ranges above, but is typically both whole and fractional values within these ranges. Further, it is to be appreciated that more than one antiwear additive may be included in the lubricant composition, in which case the total amount of all the antiwear additive included is within the above ranges.

The lubricant composition may also include a pour point depressant. Any pour point depressant known in the art may be included. The pour point depressant is typically selected from polymethacrylate and alkylated naphthalene derivatives, and combinations thereof.

If included, the pour point depressant may be included in the lubricant composition in an amount of from about 0.01 to about 5, alternatively from about 0.01 to about 2, alternatively from about 0.01 to about 1, alternatively from about 0.1 to about 0.5, wt. % based on the total weight of the lubricant composition. Alternatively, the pour point depressant may be included in the lubricant composition in amounts of less than about 5, less than about 4, less than about 3, less than about 2, less than about 1, wt. %, each based on the total weight of the lubricant composition. The amount of pour point depressant may vary outside of the ranges above, but is typically both whole and fractional values within these ranges. Further, it is to be appreciated that more than one pour point depressant may be included in the lubricant composition, in which case the total amount of all the pour point depressant included is within the above ranges.

The lubricant composition may also include an antifoam agent. Any antifoam agent known in the art may be included. The antifoam agent is typically selected from silicone antifoam agents, acrylate copolymer antifoam agents, and combinations thereof.

If included, the antifoam agent may be included in the lubricant composition in an amount of from about 1 to about 1000, alternatively from about 1 to about 500, alternatively from about 1 to about 400, ppm based on the total weight of the lubricant composition. Alternatively, the antifoam agent may be included in the lubricant composition in amounts of less than about 1000, less than about 500, less than about 400, ppm, each based on the total weight of the lubricant composition. The amount of antifoam agent may vary outside of the ranges above, but is typically both whole and fractional values within these ranges. Further, it is to be appreciated that more than one antifoam agent may be included in the lubricant composition, in which case the total amount of all the antifoam agent included is within the above ranges.

In addition to the components described above, e.g., the ashless fuel additive, the base oil, the detergent, etc., the lubricant composition may additionally include one or more additives to improve various chemical and/or physical properties. Non-limiting examples of the one or more additives include antioxidants, metal passivators, and viscosity index improvers. Each of the additives may be used alone or in combination. If included, the one or more additives can be included in various amounts.

In various embodiments, the lubricant composition comprises, consists essentially of, or consists of the amine, an API Group I oil(s), a detergent comprising a metal sulfonate, and a dispersant comprising polybutenyl succinic anhydride polyamine.

In some embodiments, the lubricant is substantially free of the detergent. The terminology "substantially free," as used immediately above and throughout this disclosure, refers to an amount of detergent (or other additive) less than about 5, alternatively less than about 4, alternatively less than about 3, alternatively less than about 2, alternatively less than about 1, alternatively less than about 0.01, alternatively about 0, wt. % based on the total weight of the lubricant composition.

In various embodiments, the lubricant composition can be further described as a fully formulated lubricant or alternatively as an engine oil. In one embodiment, the terminology "fully formulated lubricant" refers to a total final composition that is a final commercial oil. This final commercial oil may include, for instance, antiwear additives, dispersants, detergents, and other customary additives.

In various embodiments, the lubricant composition comprises, consists of, or consists essentially of:

(i) the amine having the following structure:

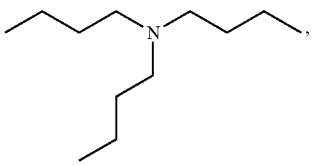

(I)

wherein $R^4$ is a linear $C_9$ to $C_{11}$ hydrocarbon, (ii) a detergent comprising a metal sulfonate, and (iii) a polybutenyl succinic anhydride polyamine.

In other embodiments, the lubricant composition comprises, consists of, or consists essentially of:

(i) the amine as an ashless fuel additive having the following structure:

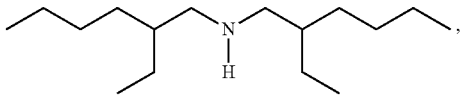

(II)

(ii) a detergent comprising a metal sulfonate, and (iii) a polybutenyl succinic anhydride polyamine.

In yet other embodiments, the lubricant composition comprises, consists of, or consists essentially of:

(i) an amine as an ashless fuel additive having the following structure:

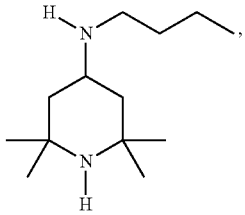

(III)

(ii) a detergent comprising a metal sulfonate, and (iii) a polybutenyl succinic anhydride polyamine.

In still other embodiments, the lubricant composition comprises, consists of, or consists essentially of:

(i) an amine as an ashless fuel additive having the following structure:

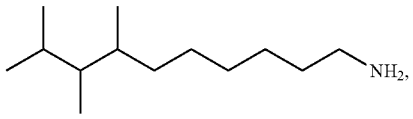

(IV)

(ii) a detergent comprising a metal sulfonate, and (iii) a polybutenyl succinic anhydride polyamine.

As alluded to above, the amine exhibits excellent solubility in the lubricant composition. Without being bound by theory, as is also explained above, it is believed that the structure of the amine contributes to the solubility of the amine. Further, the TBN of the amine allows for use of a minimal amount of amine in the lubricant composition and also allows for a reduction in the amount of the detergent in the lubricant composition. Furthermore, it is also believed that the various structural embodiments of the amine set forth above in combination with a detergent comprising a metal sulfonate, and a polybutenyl succinic anhydride polyamine yields a homogenous lubricant composition which does not phase separate and/or yield a precipitate (has excellent solubility characteristics) even when stored for various times (e.g. 90 days) at various temperatures (e.g. −4° C., 4° C., 45° C., or 60° C.). For example, in various embodiments, the lubricant composition remains homogeneous and does not phase separate when exposed to: a temperature of 60° C. for 90 days; a temperature of 45° C. for 90 days; a temperature of 4° C. for 90 days; and/or a temperature of −4° C. for 90 days. All the while, the lubricant composition is ashless (or low ash). The word "ashless" as used herein to describe the lubricant composition refers to the lubricant composition including the amine, which is ashless, and therefore a lubricant composition including less detergent, which can contribute to ash formation.

The lubricant composition may also be further defined as ashless or ash-containing, according to ASTM D 874 or as is known in the art. Typically, the terminology "ashless" refers to the absence of significant amounts of metals such as sodium, potassium, calcium, and the like. Of course, it is to be understood that the lubricant composition is not particularly limited to being defined as ashless because use of the word ashless is intended to reflect use of the amine, which is ashless, and subsequent reduction of detergent, which can contribute to ash, in the composition and thus the lubricant composition could be interpreted as ash-containing, e.g. interpreted as a "reduced ash composition".

In one or more embodiments, the lubricant composition may be classified as a low SAPS lubricant having a sulfated ash content of no more than 8, 7, 6, 5, 4, 3, 2, 1, or 0.5, wt. %, based on the total weight of the lubricant composition when tested according to ASTM D874. The term "SAPS" refers to sulfated ash, phosphorous and sulfur. Alternatively, in one or more embodiments, the lubricant composition may be classified as having a sulfated ash value of less than about 45,000, alternatively less than about 40,000, alternatively less than about 35,000, alternatively less than about 30,000, alternatively less than about 25,000, ppm when tested according to ASTM D874.

The subject disclosure also provides a method of lubricating an internal combustion engine. The method of lubricating an internal combustion engine comprises the steps of injecting a fuel and the lubricant composition into a cylinder to form a mixture, and combusting the mixture via compression-ignition. In various embodiments, the fuel and the lubricant composition are injected into the cylinder at a ratio of from about 100:1 to about 1000:1, alternatively from about 200:1 to about 400:1. The lubricant composition and the components thereof, e.g. the amine, the detergent, etc. are set forth and described above. In one embodiment, the fuel comprises sulfur, e.g. diesel fuel comprising sulfur.

In a typical embodiment, the lubricant composition is used in a diesel engine (also known in the art as a compression-ignition engine). Diesel engines are typically internal combustion engines that use the heat of compression to initiate ignition and burn the fuel and the lubricant composition is injected into the cylinder/combustion chamber. Compression-ignition engines lie in contrast to spark-ignition engines such as a gasoline (petrol) engine or gas engine (using a gaseous fuel as opposed to gasoline), which use a spark plug to ignite an air-fuel mixture. In one specific embodiment, the combustion engine is further defined as a compression-ignition internal combustion engine for a marine vessel, i.e., a marine combustion engine. In another specific embodiment, the combustion engine is further defined as a compression-ignition internal combustion engine for a train, i.e., a train or railroad combustion engine. Of course, the ashless fuel additive is not limited to use in combustion engines for marine applications. Use of the ashless fuel additive in other combustion engines, for other applications, such as automobiles, trucks, aircraft, trains, motorcycles, scooters, ATVs, lawn equipment, etc., is also contemplated herein.

In this method, a mixture comprising the combined fuel and lubricant composition is injected/introduced into a cylinder of the internal combustion engine and combusted to move a piston and power the internal combustion engine. In one embodiment, the fuel and the lubricant are combined in advance of injection into the cylinder. In another embodiment, the fuel and the lubricant are injected separately into the cylinder. In yet another embodiment, the fuel and lubricant are combined in the cylinder.

The following examples are intended to illustrate the instant disclosure and are not to be viewed in any way as limiting to the scope of the instant disclosure.

EXAMPLES

Examples 1-4 are lubricant compositions according to the subject disclosure. Examples 1-4 include an amine, a detergent, and a dispersant. The components and amount of each component in the lubricant compositions of Examples 1-4 are set forth in Table 1 below.

To form Examples 1-4, a base composition (Base Concentrate) is first formed. To form the base composition, a base oil, the detergent, an antifoam agent, a pour point depressant, and the dispersant are added to a vessel and blended for 1 hour at 70° C. Next, an antiwear additive and an antioxidant are added to the vessel, and the components are further blended for an hour at 50° C. to form the base composition. Once formed, the base composition, the amine, and the additional base oil are blended in the amounts set forth in Table 1 for an additional hour at 50° C. to form each respective Example.

TABLE 1

| | TBN ASTM D2896 | Example 1 wt (g) | Example 2 wt (g) | Example 3 wt (g) | Example 4 wt (g) |
|---|---|---|---|---|---|
| Base Concentrate | 119.3 | 120.0 | 120.0 | 120.0 | 120.0 |
| Amine A | 530.6 | 24.9 | — | — | — |
| Amine B | 278.2 | — | 47.6 | — | — |
| Amine C | 234.0 | — | — | 57.1 | — |
| Amine D | 309.0 | — | — | — | 43.2 |
| Base Oil B | 1.5 | 98.3 | 2.0 | 1.2 | 1.6 |
| Base Oil A | 1.5 | 156.8 | 230.5 | 221.7 | 235.3 |
| Blend 1 hr @ 50° C. | | | | | |
| Total | — | 400.00 | 400.00 | 400.00 | 400.00 |

Base Concentrate:

Detergent is an overbased calcium sulfonate detergent.

Antifoam Agent is a silicone antifoam agent.

Pour Point Depressant is a polymethacrylate pour point depressant.

Dispersant is polyisobutylene succinic anhydride polyamine.

Antioxidant is an octylated/butylated diphenylamine.

Antiwear Additive is ZDDP.

Amine A is n-butyl-2,2,6,6-tetramethylpiperidin-4-amine.

Amine B is 7,8,9,-trimethyl-deacan-1-amine.

Amine C is di(2-ethylhexyl)amine.

Amine D is tributylamine.

Base oil A is a high viscosity base oil.

Base Oil B is a low viscosity base oil.

Various physical properties of the lubricant compositions of Examples 1-4 are set forth in Table 2 below.

TABLE 2

| | Example 1 | Example 2 | Example 3 | Example 4 |
|---|---|---|---|---|
| KV40 (cSt) ASTM D 445 | 225.3 | 187.4 | 152.0 | 153.2 |
| KV100 (cSt) ASTM D 445 | 19.9 | 18.2 | 16.3 | 16.6 |
| SAE engine oil viscosity grade (SAE 50 = 16.3 ≤ KV100 < 21.9 cSt) SAE J300 | 50.0 | 50.0 | 50.0 | 50.0 |
| TBN (mg KOH/g) ASTM D 2896 | 70.6 | 70.9 | 69.3 | 69.2 |
| TBN Ratio Contribution of the Amine (mg KOH/g) ASTM D 2896 | 50.0 | 50.0 | 50.0 | 50.0 |
| TBN Ratio Contribution of the Amine (mg KOH/g) ASTM D 2896 | 33.0 | 33.0 | 33.0 | 33.0 |
| TBN (mg KOH/g) ASTM D 4739 | 64.5 | 66.3 | 66.5 | 65.0 |
| TAN (mg KOH/g) ASTM D 664 | 3.0 | 2.5 | 2.2 | 2.4 |
| Sulfated ash (%) ASTM D 874 | 4.3 | 4.3 | — | — |
| DSC Oxidation induction time (210° C.) ASTM D 6186 | 29.0 | 1.6 | 5.4 | 2.9 |
| Panel Coker Test (320° C., 3 hours) FTM 3462 | 30.1 | 29.0 | 32.2 | 32.2 |
| Solubility (after storage at 60° C. for 90 days) | Homogeneous and does not phase separate | Homogeneous and does not phase separate | Homogeneous and does not phase separate | Homogeneous and does not phase separate |

Referring now to table 2, Examples 1-4, which include the amine, yield lower levels of sulfated ash. Further, the Examples 1-4 exhibit excellent solubility and do not phase separate and/or yield a precipitate upon storage.

It is to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, it is to be appreciated that different, special, and/or unexpected results may be obtained from each member of the respective Markush group independent from all other Markush members. Each member of a Markush group may be relied upon individually and/or in combination and provides adequate support for specific embodiments within the scope of the appended claims.

It is also to be understood that any ranges and subranges relied upon in describing various embodiments of the present invention independently and collectively fall within the scope of the appended claims and are understood to describe and contemplate all ranges, including whole and/or fractional values therein, even if such values are not expressly written herein. One of skill in the art readily recognizes that the enumerated ranges and subranges sufficiently describe and enable various embodiments of the present invention and such ranges and subranges may be further delineated into relevant halves, thirds, quarters, fifths, and so on. As just one example, a range "from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims and may be relied upon individually and/or collectively and provide adequate support for specific embodiments within the scope of the appended claims.

In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange ranging from at least 10 to 35, a subrange ranging from at least 10 to 25, a subrange from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "from 1 to 9" includes various individual integers, such as 3, as well as individual numbers including a decimal point (or fraction), such as 4.1, which may be relied upon and provide adequate support for specific embodiments within the scope of the appended claims.

The invention has been described in an illustrative manner and it is to be understood that the terminology which has been used is intended to be in the nature of words of description rather than of limitation. Many modifications and variations of the present invention are possible in light of the above teachings and the invention may be practiced otherwise than as specifically described.

What is claimed is:

1. A lubricant composition for a compression-ignition internal combustion engine, said lubricant composition comprising:

(i) an amine as an ashless fuel additive, wherein said amine has the following structure:

(III)

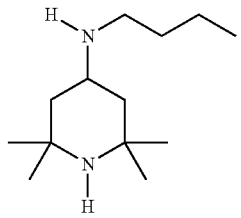

wherein said amine has a TBN of from about 275 to about 600 mg KOH/g when tested according to ASTM D2896, and (ii) a detergent comprising an overbased metal sulfonates, wherein a TBN of said lubricant composition is from about 20 to about 130 mg KOH/g when tested according to ASTM D2896; and wherein a TBN contribution of said amine to said TBN of said lubricant composition is greater than about 30%.

2. A lubricant composition as claimed in claim 1, wherein a TBN contribution of said amine to said TBN of said lubricant composition is greater than a TBN contribution of said detergent to said TBN of said lubricant composition.

3. A lubricant composition as claimed in claim 1, consisting essentially of components (i), (ii), and (iii) a dispersant.

4. A lubricant composition as claimed in claim 1, wherein said amine is present in an amount of from about 1 to about 45 wt. % based on the total weight of said lubricant composition, and said overbased metal sulfonate is present in an amount of from about 0.1 to about 35 wt. % based on the total weight of said lubricant composition.

5. A lubricant composition as claimed in claim 1, wherein said amine has a TBN of from about 500 to about 800 mg KOH/g when tested according to ASTM D2896.

6. A lubricant composition as claimed in claim 1, further comprising a polyisobutylene succinic anhydride polyamine and/or a polyalkenyl succinimide polyamine having a weight average molecular weight (Mw) of from about 200 to about 3000 g/mol.

7. A lubricant composition as claimed in claim 1, further comprising a base oil selected from American Petroleum Institute (API) Group I oil, API Group II oil, API Group III oil, API Group IV oil, API Group V, and combinations thereof.

8. A lubricant composition as claimed in claim 1, further comprising an antifoam agent selected from silicone antifoam agents, acrylate copolymer antifoam agents, and combinations thereof, and wherein said antifoam agent is present in an amount of from about 1 to about 1000 ppm based on the total weight of said lubricant composition.

9. A lubricant composition as claimed in claim 1, that remains homogeneous and does not phase separate when exposed to a temperature of 60° C. for 90 days.

10. A lubricant composition as claimed in claim 1, having a sulfated ash value of less than about 45,000 ppm when tested according to ASTM D874.

11. A marine cylinder lubricant composition comprising:

(i) a secondary amine as an ashless fuel additive, said amine having the following structure:

(III)

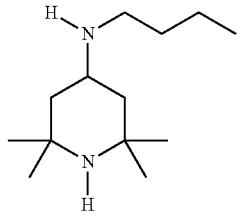

(ii) an overbased metal sulfonate (iii) a polyalkenyl succinic anhydride polyamine, and (iv) a base oil selected from American Petroleum Institute (API) Group I oil, API Group II oil, API Group III oil, API Group IV oil, API Group V, and combinations thereof, wherein a TBN of said lubricant composition is from about 20 to about 130 mg KOH/g when tested according to ASTM D2896;

wherein a TBN contribution of said secondary amine to said TBN of said lubricant composition is greater than about 30%.

12. A method of lubricating an internal combustion engine with the lubricant composition as claimed in claim 11, said method comprising the steps of:

(A) injecting a diesel fuel including sulfur and the lubricant composition at a ratio of from about 100:1 to about 1000:1 into the cylinder to form a mixture;

(B) combusting the mixture comprising the diesel fuel and the lubricant composition via compression-ignition.

13. A method of lubricating an internal combustion engine as claimed in claim 12, wherein said lubricant composition has a sulfated ash value of less than about 25,000 ppm when tested according to ASTM D874.

14. A method of lubricating an internal combustion engine as claimed in claim 12, wherein the internal combustion engine is a marine engine.

15. A method of lubricating an internal combustion engine as claimed in claim 12, wherein the diesel fuel and the lubricant composition are combined at a ratio of from about 200:1 to about 400:1.

* * * * *